US008342608B1

(12) United States Patent
Cook

(10) Patent No.: US 8,342,608 B1
(45) Date of Patent: Jan. 1, 2013

(54) THERAPEUTIC BACK SUPPORT

(76) Inventor: Gerry Cook, Sandpoint, ID (US)

( * ) Notice: Subject to any disclaimer, the term of this patent is extended or adjusted under 35 U.S.C. 154(b) by 162 days.

(21) Appl. No.: 12/807,241

(22) Filed: Aug. 31, 2010

Related U.S. Application Data

(60) Provisional application No. 61/275,533, filed on Aug. 31, 2009.

(51) Int. Cl.
*A47C 31/00* (2006.01)

(52) U.S. Cl. ..... 297/485; 128/876

(58) Field of Classification Search ..... 297/465, 297/485; 128/874, 876
See application file for complete search history.

(56) References Cited

U.S. PATENT DOCUMENTS

| | | | | |
|---|---|---|---|---|
| 4,093,307 | A | 6/1978 | McLennan | |
| 4,383,713 | A | 5/1983 | Roston | |
| 4,583,533 | A | 4/1986 | Goodley et al. | |
| 4,819,278 | A | 4/1989 | Ramos | |
| 4,881,528 | A | 11/1989 | Scott | |
| 4,898,185 | A * | 2/1990 | Fuller | 297/485 |
| 4,981,148 | A * | 1/1991 | Fuller | 128/876 |
| 5,123,427 | A * | 6/1992 | Watt et al. | 128/876 |
| 5,628,548 | A * | 5/1997 | Lacoste | 297/484 |
| 5,848,984 | A | 12/1998 | Bachar et al. | |
| 6,007,156 | A * | 12/1999 | Chang | 297/465 |
| 6,042,189 | A * | 3/2000 | Wellman | 297/465 |
| 6,082,826 | A * | 7/2000 | Moreno | 297/464 |
| 6,616,242 | B1 * | 9/2003 | Stoll | 297/485 |
| 7,448,682 | B2 | 11/2008 | Rutty | |
| 8,007,046 | B2 * | 8/2011 | Rothschild | 297/485 |
| 2007/0052272 | A1 | 3/2007 | Fabel | |
| 2009/0146475 | A1 | 6/2009 | Rutty | |

* cited by examiner

*Primary Examiner* — Peter R. Brown
(74) *Attorney, Agent, or Firm* — Richard C. Conover

(57) ABSTRACT

A Velcro loop pad portion facing outwardly is fitted on the front surface of a back of a chair. A harness having straps extending over the top of the back of the chair secures the Velcro loop pad to the chair. A waist belt having a Velcro hook panel sewn to the waist belt with the Velcro hook panel facing outwardly adjacent the back of the user. The Velcro hook panel is adapted to cooperate with the Velcro loop pad to transfer weight of a user to the back of the chair while seated in the chair. The harness straps extending over the top of the back of the chair support the Velcro loop pad to keep the Velcro loop pad in place when being used.

2 Claims, 5 Drawing Sheets

THERAPEUTIC BACK SUPPORT

This application claims the benefit of provisional application Ser. No. 61/275,533 filed Aug. 31, 2009.

BACKGROUND OF INVENTION

The present invention relates to a therapeutic back support which can be used by a user sitting in a chair. With the present invention weight is removed from the spine when the user sits in the chair.

There are many persons today who suffer from lower back aches and back pain. To alleviate the pain, persons suffering from back pain try to get off their feet to take weight off their lower back. The mere sitting in a chair does not reduce the weight of the torso off their lower back but many persons find that it is necessary to sit much of the time either at a desk or time traveling in automobiles or airplanes. The sitting process places significant stress on the lower back.

A back support for use with a chair is known such as shown in United States Patent Application Publication No. 2009/0146475 to Rutty. The Rutty reference describes fitting a rib band wrapped around the user's rib cage, just under the arms. The rib band includes a Velcro type surface adapted to connect with a Velcro surface disposed on the front of a chair back. When a user sits in a chair and the Velcro surfaces are meshed together, the rib band will support some weight of the user which is transferred to the seat-back through the hook-loop connection.

SUMMARY OF INVENTION

The present invention is a improvement over known devices by providing a waist belt for fitting around the waist of the user underneath the rib cage; thereby, transferring weight of the user from a position on the torso of the user closer to the location of the back pain to be alleviated. Further, the present invention describes a harness apparatus for securing a Velcro pad to the back of a chair being used which cooperates with a Velcro panel secured to the waist belt.

The present invention includes a Velcro loop pad portion positioned to face outwardly at the front of the back of the chair and a harness having straps extending over the top of the back of the chair for securing the Velcro loop pad to the front of the back of the chair. Further, an elongate waist belt having a generally wide configuration is provided. A Velcro hook panel is sewn onto the waist belt midway between the ends thereof and connectors are used for connecting the ends of the elongate waistband together with the Velcro hook panel facing outwardly. The waist belt is adapted to be positioned around the waist of the user with the Velcro hook panel positioned adjacent to back of the user. The Velcro hook panel is adapted to cooperate with the Velcro loop pad positioned on the back of the chair for transferring weight of a torso of a user to the back of the chair while seated in the chair with the user's back resting against the back of the chair. The harness straps extending over the top of the back of the chair support the Velcro loop pad to keep the Velcro loop pad in place when being used.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
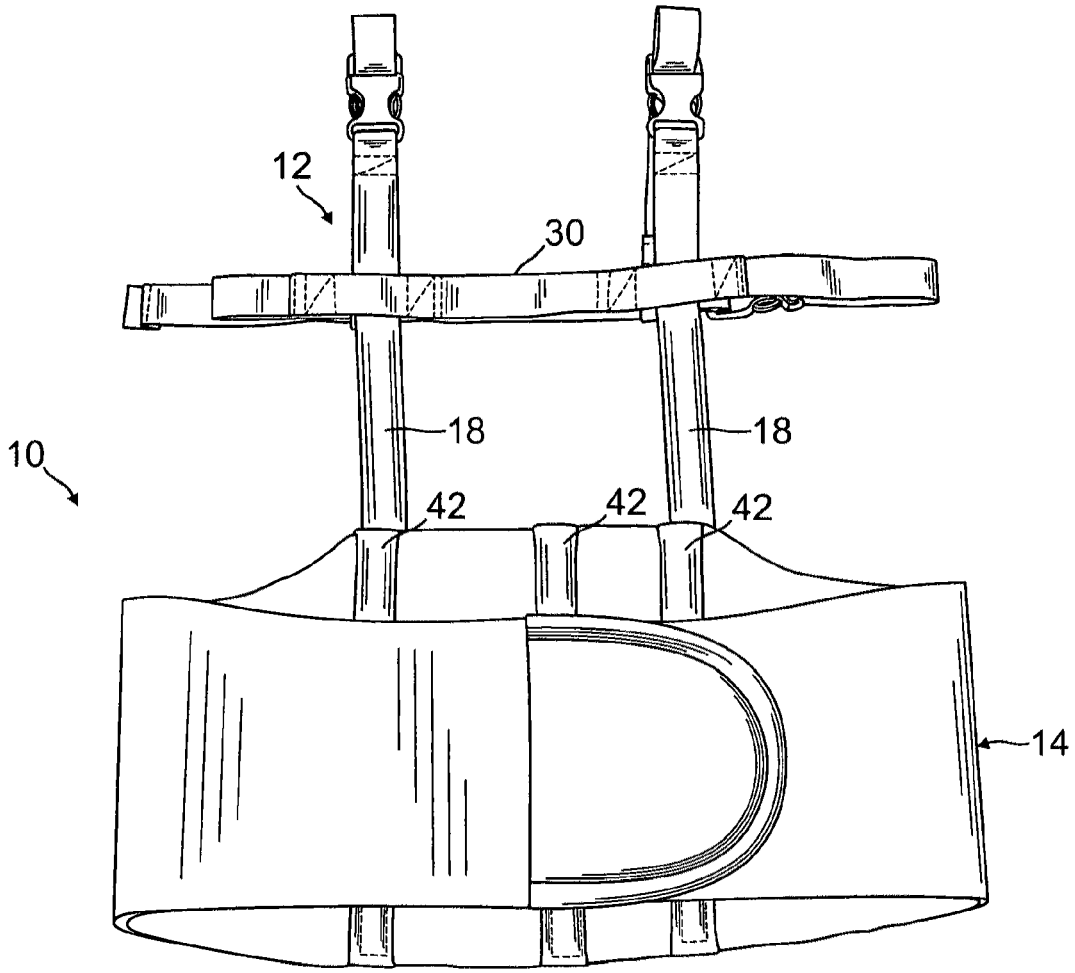
FIG. 1 is a perspective view of a therapeutic back support according to the present invention.

A therapeutic back support 10 according to the present invention is shown in FIG. 1. The therapeutic back support 10 includes two separate elements. The first element is a harness 12 which fits on the back panel of a conventional chair. The second portion is a waist belt 14 which fits around the waist of a user.

Figure 2:
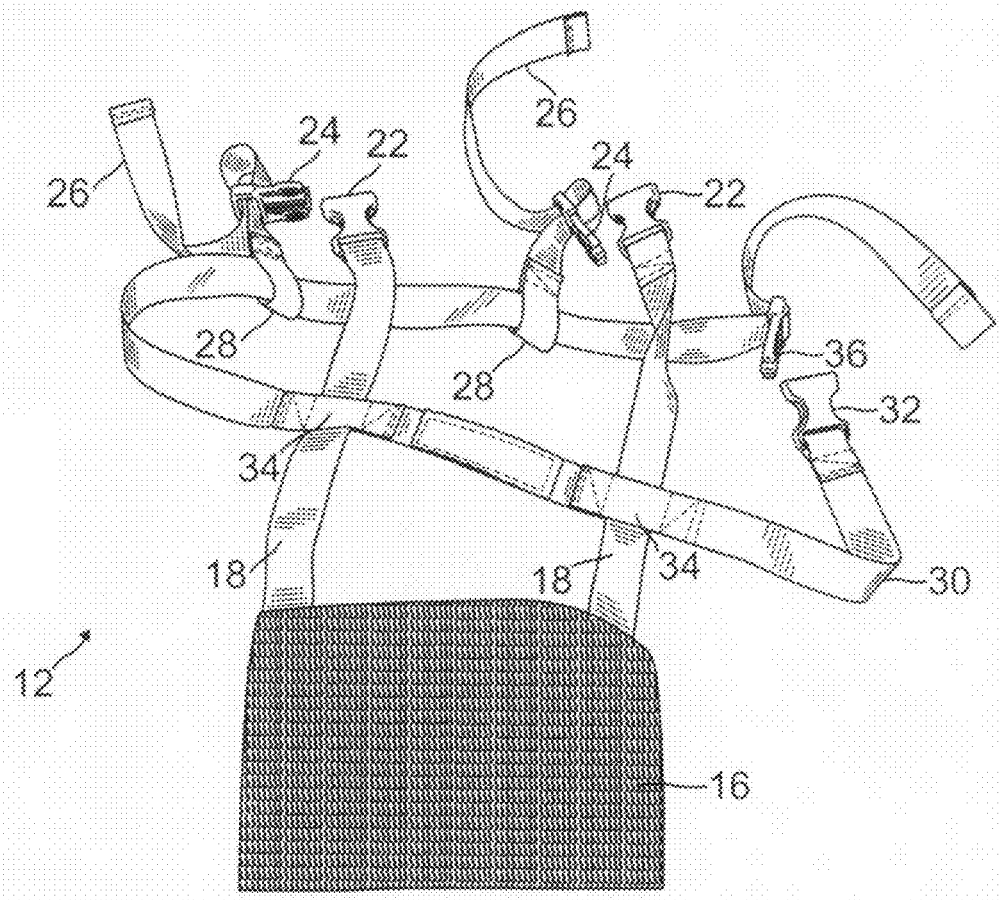
FIG. 2 is a perspective view of a chair harness used with the present invention.

The harness 12 is shown in FIG. 2. The harness 12 includes a Velcro loop pad 16 to which is attached by sewing a pair of straps 18. At a distal end of the straps 18, a female buckle 22 is attached. Male buckles 24 are provided for buckling with female buckles 22. A strap 26 is slidably attached to each male buckle 24 to allow for length adjustment of the straps 26. At one end of each strap 26, a loop 28 is sewn.

Figure 3:
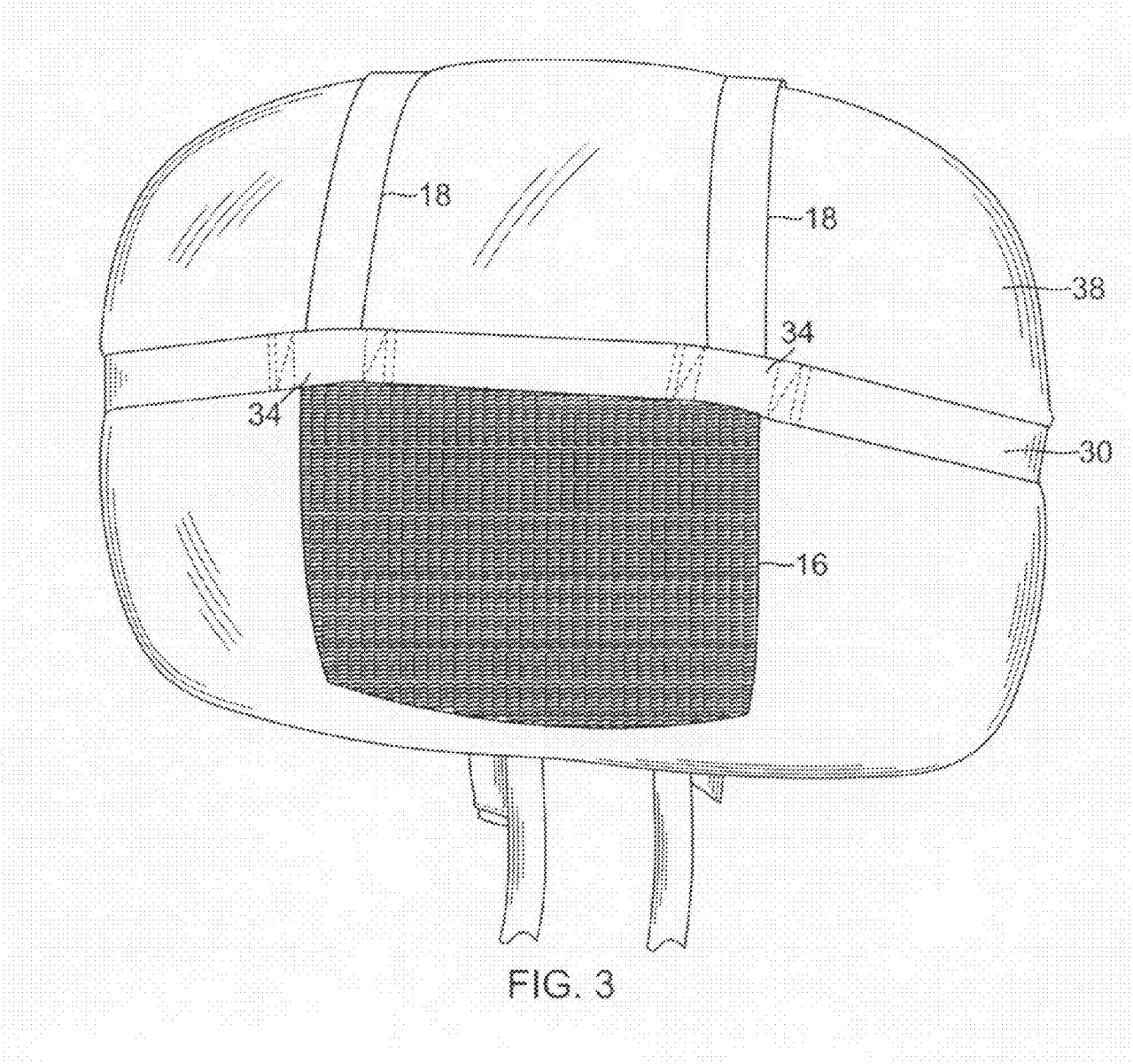
FIG. 3 is a front perspective view of the chair harness mounted on a back panel of a chair.

A strap 30 is also provided as shown in FIG. 2 having a female buckle 32 mounted at one end thereof. A pair of strap portion 34 are sewn to the strap 30 leaving openings (not shown) through which the straps 18 are threaded as shown in FIGS. 2 and 3. Further, the strap 30 is threaded through the loops 28 and is extended to a male buckle 36. The male buckle 36 is provided with conventional structure for allowing length adjustment of the strap 30.

Figure 4:
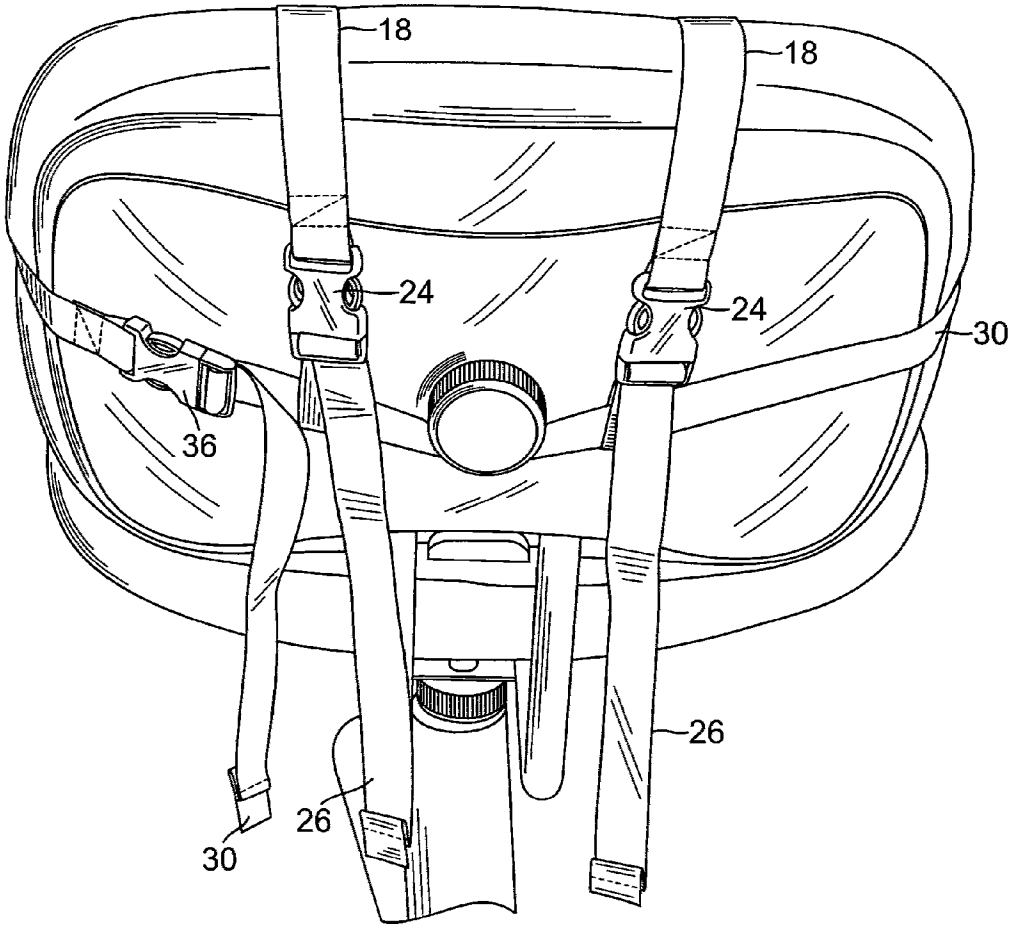
FIG. 4 is a rear perspective view of the chair harness mounted on the back panel of a chair.

The harness 12 is used for mounting the Velcro pad 16 to the back panel 38 of a chair as shown in FIGS. 3 and 4. The straps 18 are placed over the top of the back panel 38 and the strap 30 is positioned laterally around the back panel 38 as shown in FIGS. 3 and 4. The length of the straps 26 are adjusted with the buckles 24 to position the Velcro pad 16 adjacent the middle back of a user sitting on the chair. Next the strap 30 is tightened with the buckle 36 so that the Velcro pad 16 is snuggly fitted on the back panel 38.

Figure 5:
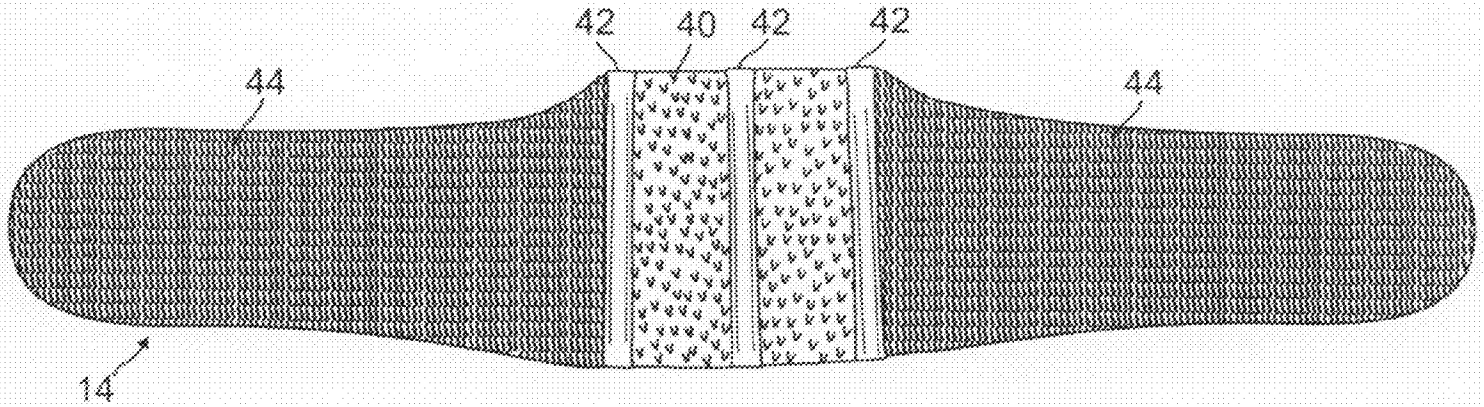
FIG. 5 is a rear elevational view of a waist belt used with the present invention.
Figure 6:
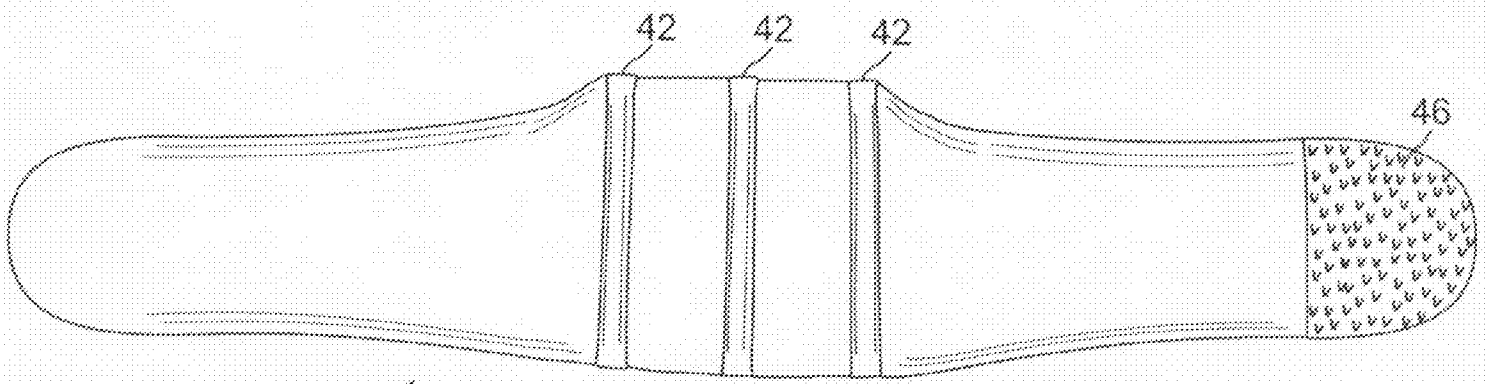
FIG. 6 is a front elevational view of the waist belt shown in FIG. 5.

The waist belt 14, in a preferred embodiment, is cut from a sheet of styrene butadiene rubber material. The belt 14 has a generally wide configuration as shown in FIGS. 1, 5 and 6. At the center of the belt 14 midway between the ends of the belt 14 a Velcro hook panel 40 is sewn. Reinforcing straps 42 are sewn through the Velcro panel 40 and the belt 14 as shown in FIGS. 5 and 6. The back side of belt 14 is provided with a Velcro loop backing material 44 as shown in FIG. 5. The front side of the belt 14 includes a Velcro hook material 46 at one end as shown in FIG. 6. When the belt 14 is wrapped around the waist of the user, the Velcro hook portion 46 is secured to the Velcro loop portion 44 to connect the ends of the belt together around the waist of a user.

In using the present invention, a user fits the harness 12 on the back panel of a chair with the straps 18 placed over the top of a back panel 38 and the strap 30 positioned laterally around the back panel 38. The lengths of the straps 26 and 30 are adjusted to position the Velcro pad 16 adjacent the middle back of a user sitting on the chair. Next, a user fits the waist belt 14 around the waist of the user and using the Velcro hook portions 46 and Velcro loop portions 44 tightly secures the waist belt 14 around the waist of the user. When the user is about to sit in the chair, the user positions himself about 6" above the seat panel of the chair and then moves backward so that the Velcro hook panel 40 abuts the Velcro loop pad 16. When the user sits down on the seat panel of the chair, the waist belt 14 is held upwardly with the engagement between the Velcro portions 40 and 16 thus relieving weight on the spine of the user.

With the present invention, strain is moved from the back in a sitting position. The therapeutic back support is easy to use and is adaptable for many types and styles of chairs.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. A therapeutic back support for use with a chair having a back and a seat comprising:

a loop fastening pad positioned to face outwardly at the front of the back of the chair;

a harness for fitting over a back of the chair;

the harness having a pair of first straps each having one end attached to the loop fastening pad and running over the top of the back and down the rear of the back of the chair;

each of the first straps having a connector at a distal end thereof;

the harness further having a second strap running laterally around the back of the chair;

each of the pair of first straps slidably connected to the second strap adjacent the loop fastening pad;

the second strap having a female and a male connector at the ends of the second strap for connecting the ends of the second strap together;

the second strap further having connector means for connecting the second strap to the connectors of the pair of first straps;

an elongate waist belt having a generally wide configuration in the lateral direction;

a hook fastening panel sewn to the waist belt midway between the ends thereof;

connecting means for connecting the ends of the elongate waist belt together with the hook fastening panel facing outwardly;

the waist belt adapted to be positioned around the waist of a user with the hook fastening panel positioned adjacent the back of the user;

the hook fastening panel adapted to cooperate with the loop fastening pad positioned on the back of the chair for transferring weight of a torso of the user to the back of the chair while seated in the chair with the user's back resting against the back of the chair.

2. The therapeutic back support according to claim 1 wherein the hook fastening panel is further provided with reinforcing straps sewn through the hook fastening pad and the waist belt.

* * * * *